US008851625B2

(12) United States Patent
Nakagawa

(10) Patent No.: US 8,851,625 B2
(45) Date of Patent: Oct. 7, 2014

(54) LIQUID EJECTING APPARATUS

(75) Inventor: Shigenori Nakagawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/413,579

(22) Filed: Mar. 6, 2012

(65) Prior Publication Data

US 2012/0229560 A1 Sep. 13, 2012

(30) Foreign Application Priority Data

Mar. 7, 2011 (JP) ..... 2011-048713

(51) Int. Cl.
*B41J 2/165* (2006.01)

(52) U.S. Cl.
CPC ..... *B41J 2/16552* (2013.01); *B41J 2/16508* (2013.01)
USPC ..... 347/29; 347/28

(58) Field of Classification Search
USPC ..... 347/28, 29
See application file for complete search history.

(56) References Cited

U.S. PATENT DOCUMENTS

| | | | | |
|---|---|---|---|---|
| 4,228,442 | A * | 10/1980 | Krull | 347/28 |
| 4,707,714 | A * | 11/1987 | Rosenthal et al. | 347/29 |
| 4,853,717 | A * | 8/1989 | Harmon et al. | 347/29 |
| 5,231,424 | A * | 7/1993 | Kaneko et al. | 347/29 |
| 5,412,411 | A * | 5/1995 | Anderson | 347/28 |
| 5,602,577 | A * | 2/1997 | Shibata et al. | 347/84 |
| 5,898,444 | A * | 4/1999 | Kobayashi et al. | 347/29 |
| 6,007,177 | A * | 12/1999 | Takanaka et al. | 347/28 |
| 6,852,145 | B2 * | 2/2005 | Muller | 95/216 |
| 6,905,189 | B1 * | 6/2005 | Duffield | 347/28 |
| 7,300,134 | B2 * | 11/2007 | Suzuki | 347/29 |
| 2003/0058301 | A1 | 3/2003 | Sekiya | |
| 2003/0179263 | A1 * | 9/2003 | Sekiya | 347/47 |
| 2003/0189616 | A1 * | 10/2003 | Yamada | 347/29 |
| 2005/0168517 | A1 * | 8/2005 | Usuda | 347/29 |

(Continued)

FOREIGN PATENT DOCUMENTS

| | | |
|---|---|---|
| JP | 4-355152 | 12/1992 |
| JP | 2004-167772 | 6/2004 |

(Continued)

OTHER PUBLICATIONS

Encyclopaedia Brittanica: a dictionary of arts, sciences, and general literature. The R.S. Pearle reprint, Chicago, R.S. Pearle & Co., 1890: vol. XI, p. 571.*

(Continued)

*Primary Examiner* — Stephen Meier
*Assistant Examiner* — Alexander D Shenderov
(74) *Attorney, Agent, or Firm* — Workman Nydegger

(57) ABSTRACT

A liquid ejecting apparatus includes: a liquid ejecting head which has a nozzle formation surface that ejects a liquid containing a solvent in a vaporized state with a specific gravity greater than that of air onto a recording medium, and is in a standby state in which the nozzle formation surface faces a lower side in the vertical direction at a standby position deviating from a region where the recording medium is disposed during non-ejection of the liquid; and a head accommodation portion which has a concave portion that accommodates at least a part including the nozzle formation surface of the liquid ejecting head in the standby state and is provided so that a bottom portion of the concave portion opposes the nozzle formation surface in a state where the part is accommodated.

8 Claims, 6 Drawing Sheets

(56) References Cited

U.S. PATENT DOCUMENTS

| | | | | |
|---|---|---|---|---|
| 2006/0077223 | A1* | 4/2006 | Kambe | 347/29 |
| 2007/0146407 | A1 | 6/2007 | Hiraoka | |
| 2007/0195122 | A1* | 8/2007 | Hiruma et al. | 347/29 |
| 2007/0252865 | A1* | 11/2007 | Sakurai | 347/29 |
| 2008/0001978 | A1* | 1/2008 | Takemoto | 347/7 |
| 2009/0096830 | A1 | 4/2009 | Shimazaki | |
| 2009/0109257 | A1 | 4/2009 | Shimazaki | |
| 2009/0201334 | A1* | 8/2009 | Hasegawa | 347/29 |
| 2010/0045733 | A1* | 2/2010 | Mano | 347/29 |

FOREIGN PATENT DOCUMENTS

| | | |
|---|---|---|
| JP | 2005-212138 | 8/2005 |
| JP | 2007-175969 | 7/2007 |
| JP | 2009-96034 | 5/2009 |
| JP | 2009-101636 | 5/2009 |
| JP | 2009-190229 | 8/2009 |

OTHER PUBLICATIONS http://en.wikipedia.org/wiki/Vapour_density.*

* cited by examiner

LIQUID EJECTING APPARATUS

BACKGROUND

1. Technical Field

The present invention relates to a liquid ejecting apparatus.

2. Related Art

As a liquid ejecting apparatus which ejects ink droplets onto a recording sheet from nozzles of an ink jet head, an ink jet type printing apparatus (hereinafter, referred to as a "printing apparatus") is widely known. Regarding the printing apparatus, in order to suppress ink in the nozzles from drying and thickening, a configuration in which a nozzle formation surface is sealed using a cap included in a maintenance unit so as to moisten the nozzle formation surface is suggested.

However, depending on gas barrier properties of the cap itself, even though the nozzle formation surface is sealed, there may be cases where vaporized solvent (vaporized component) is diffused to the outside via the cap. If this occurs, moisture retention of the nozzle formation surface is degraded, and the solvent is vaporized from the nozzles.

SUMMARY

An advantage of some aspects of the invention is that it provides a liquid ejecting apparatus capable of reducing vaporization of a solvent from nozzles.

According to an aspect of the invention, there is provided a liquid ejecting head which has a nozzle formation surface in which nozzles are formed that eject a liquid containing a solvent in a vaporized state with a specific gravity greater than that of air onto a recording medium, and is in a standby state in which the nozzle formation surface faces a lower side in the vertical direction at a standby position deviating from a region where the recording medium is disposed during non-ejection of the liquid; and a head accommodation portion which has a concave portion that accommodates at least a part including the nozzle formation surface of the liquid ejecting head in the standby state and is provided so that a bottom portion of the concave portion opposes the nozzle formation surface in a state where the part is accommodated.

According to the aspect of the invention, since the specific gravity of the solvent in the vaporized state (vaporized component) is greater than that of air, the vaporized component is moved to the lower side in the vertical direction. Since the nozzle formation surface is accommodated in the concave portion in the standby state and the bottom portion of the concave portion opposes the nozzle formation surface, for example, the vaporized component vaporized in the periphery of the liquid ejecting head in the standby state is moved to the bottom portion of the concave portion and is gradually collected from the bottom portion. When the vaporized component is collected in the concave portion, the periphery of the nozzle formation surface accommodated in the concave portion can be filled with the vaporized component. Accordingly, vaporization of the solvent from the nozzles can be reduced.

It is preferable that the liquid ejecting apparatus further include a cap portion which is accommodated in the concave portion and seals the nozzle formation surface.

According to the aspect of the invention, since the cap portion which is accommodated in the concave portion and seals the nozzle formation surface is further included, vaporization of the solvent from the nozzle formation surface can be reduced.

It is preferable that the liquid ejecting apparatus further include a liquid component supply unit which supplies a liquid component of the solvent to the concave portion.

According to the aspect of the invention, since the liquid component of the solvent is supplied to the concave portion by the liquid component supply unit, the solvent in the concave portion is vaporized, and thus the periphery of the nozzle formation surface in the standby state of the liquid ejecting head can be filled with the vaporized component of the solvent. Accordingly, vaporization of the solvent from the nozzle formation surface can be reduced.

It is preferable that in the liquid ejecting apparatus, the liquid component supply unit include: a storage portion that stores the liquid component; a tube portion that connects the storage portion to the concave portion; and a movement portion which moves the liquid component stored in the storage portion to the concave portion via the tube portion.

According to the aspect of the invention, since the liquid component supply unit includes: the storage portion that stores the liquid component; the tube portion that connects the storage portion to the concave portion; and the movement portion which moves the liquid component stored in the storage portion to the concave portion via the tube portion, the liquid can be supplied to the concave portion without using a complex configuration.

It is preferable that the liquid ejecting apparatus further include a recovery unit that recovers the liquid discharged from the liquid ejecting head, and the recovery unit be used as the storage portion that stores the liquid component of the solvent contained in the liquid.

According to the aspect of the invention, since the recovery unit that recovers the liquid discharged from the liquid ejecting head is further included, and the recovery unit is used as the storage portion that stores the liquid component of the solvent contained in the liquid, the discharged liquid can be re-used.

It is preferable that the liquid ejecting apparatus further include a vaporized component supply unit that supplies a vaporized component of the solvent to the concave portion.

According to the aspect of the invention, since the vaporized component supply unit that supplies the vaporized component of the solvent to the concave portion is further included, the periphery of the nozzle formation surface of the liquid ejecting head contained in the concave portion can be directly filled with the vaporized component.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

Figure 1:
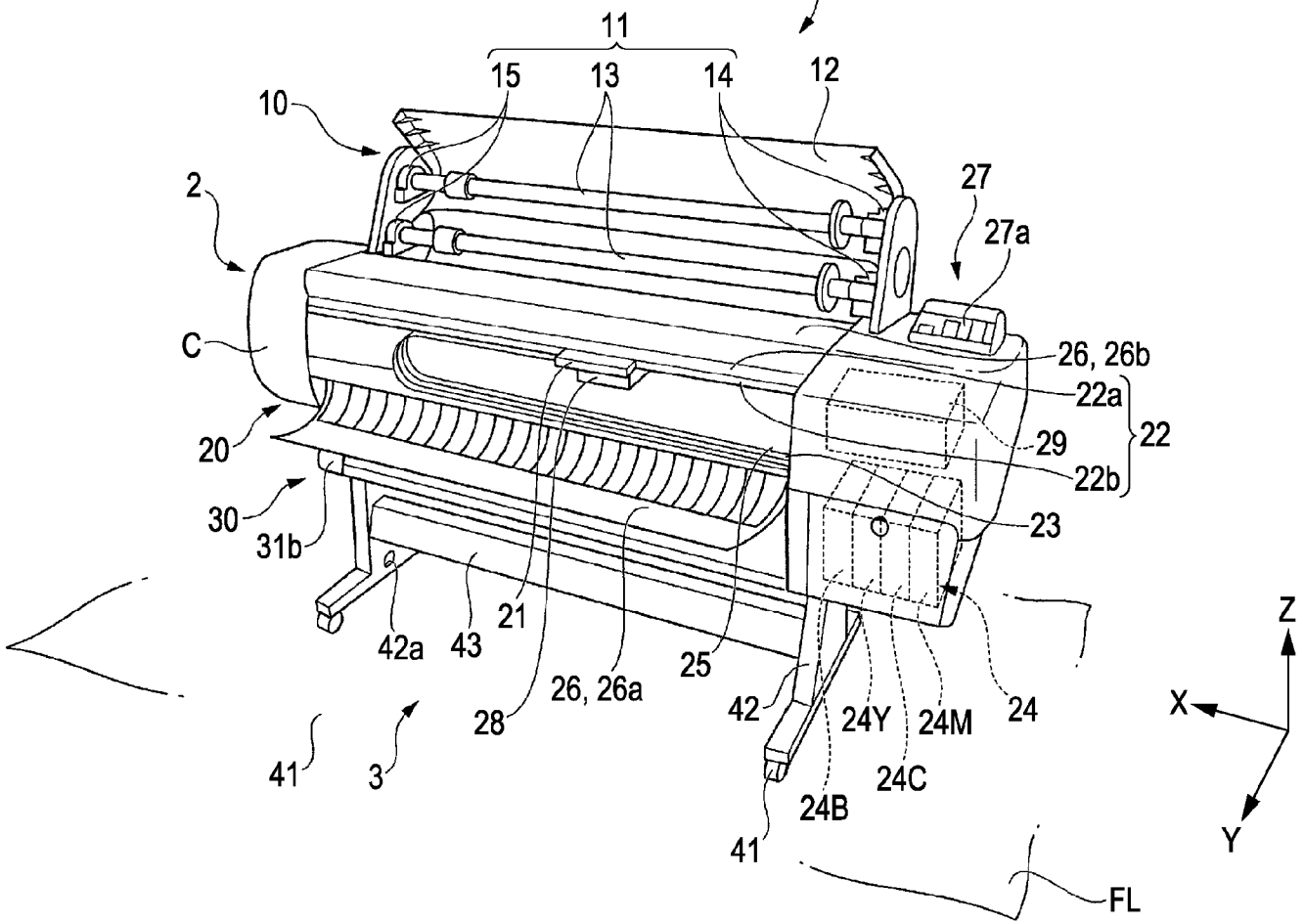
FIG. 1 is a diagram illustrating the configuration of a printing apparatus according to an embodiment of the invention.

FIG. 1 is a perspective view illustrating the configuration of a printing apparatus 1 according to the embodiment.

As illustrated in FIG. 1, the printing apparatus (liquid ejecting apparatus) 1 is an ink jet type large-format printer (LFP) which performs recording on a recording sheet of a relatively large size such as A1 size in the JIS standard or B1 size in the JIS standard and is configured to include a printer body 2 and a leg section 3. The printing apparatus 1 is in a state of being placed on a floor surface FL.

Hereinafter, in this embodiment, there may be cases where each component is described using the XYZ orthogonal coordinate system. When the XYZ orthogonal coordinate system is used, a plane parallel to the floor surface FL is represented as the XY plane, and a direction perpendicular to the floor surface FL (vertical direction) is represented as the Z direction. On the XY plane, a transportation direction of a recording sheet is represented as the Y direction, and a direction orthogonal to the Y direction is represented as the X direction.

The printer body 2 includes a paper feeding unit 10, a recording unit 20, and a paper discharge unit 30.

The paper feeding unit 10 is provided at the upper part of the recording unit 20 and is provided to protrude from the rear surface side. The paper feeding unit 10 is provided with a roll paper holder 11 and a roll paper cover 12.

The roll paper holder 11 is a part in which a recording sheet (hereinafter, referred to as roll paper) in a single roll form is installed and is provided in the paper feeding unit 10. The roll paper holder 11 includes a spindle portion 13 and spindle receiving portions 14 and 15. The spindle portion 13 is a shaft member that holds the roll paper and extends in the left and right direction in the figure. The spindle portion 13 is provided with roll paper pressing portions such that the position of the roll paper is fixed so as not to deviate by pressing the roll paper held by the spindle portion 13 from both sides. The spindle receiving portions 14 and 15 are bearing portions that rotatably support the spindle portion 13.

The roll paper cover 12 is a flip-up type cover member which can be opened and closed, and is mounted on the outside of the paper feeding unit 10. The overall roll paper cover 12 is rotatably supported. The roll paper cover 12 can be in an opened state as a user pushes up a lower portion of the roll paper cover 12 and can be in a closed state as the user pushes down the lower portion thereof. In FIG. 1, the roll paper cover 12 is in the opened state. The roll paper cover 12 covers the roll paper holder 11 in the closed state.

The recording portion 20 has a carriage 21, a carriage moving mechanism 22, a flexible flat cable (FFC) 23, an ink tank (fluid supply tank) 24, an ink tube 25, a lid member 26, an operation panel 27, and a maintenance unit 29, and further has, for example, a control unit 100 (not shown), a paper transporting roller (not shown), a waste liquid collecting unit (not shown), and the like.

The carriage 21 is a holding member that holds the recording head (ejecting head) 28 and can be moved in the main scanning direction by the carriage moving mechanism 22. The recording head 28 has a recording head for black ink, which discharges black (B) ink, and has recording heads for a plurality of color inks which respectively discharge, for example, yellow (Y), cyan (C), and magenta (M) inks. The recording head 28 has a pressure generation chamber and nozzle openings connected to the pressure generation chamber. The inks are stored in the pressure generation chamber, and by pressurizing the pressure generation chamber to a predetermined pressure in the state where the inks are stored, ink droplets are ejected onto roll paper from the nozzle openings. The ink ejection operation by the recording head 28 is controlled by, for example, the control unit 100.

The carriage moving mechanism 22 has a rail 22*a* and a carriage belt 22*b*. The carriage 21 is suspended from the rail 22*a* via a roller (not shown), and the carriage 21 can be moved in the main scanning direction via the roller. The carriage 21 is connected to the carriage belt 22*b*, and the carriage belt 22*b* itself is moved in the main scanning direction. As the carriage belt 22*b* is moved in the main scanning direction, the carriage 21 can be reciprocated in the main scanning direction while being guided by the rail 22*a*. The movement of the carriage belt 22*b* is controlled by, for example, the control unit 100.

The FFC 23 is a cable that electrically connects the recording head 28 to the control unit 100, and has a configuration in which one end portion thereof is connected to a connector of the recording head 28 and the other end portion thereof is connected to a connector of the control unit 100. A recording signal from the control unit 100 is transmitted to the recording head 28 via the FFC 23.

The ink tank 24 is accommodated in an ink tank holder (not shown) provided at the right end of the recording unit 20 in the figure, and has ink tanks 24B, 24Y, 24C, and 24M that hold inks corresponding to the respective colors (black, yellow, cyan, and magenta) ejected from the respective recording heads 28.

The ink tube 25 is a tube member that connects the recording head 28 to the ink tank 24, and is separately provided for each of the colors. An ink pressurization supply mechanism (not shown) is connected to the ink tube 25, and the respective color inks pressurized by the corresponding ink pressurization supply mechanisms are sent from the respective ink tanks 24 to the recording heads 28. The operation of the ink pressurization supply mechanism is controlled by, for example, the control unit 100.

The lid member 26 has a front lid 26*a* and an upper lid 26*b*. The front lid 26*a* is provided in front of the recording unit 20 to cover the carriage 21, the carriage moving mechanism 22, the ink tube 25, and the like. The front lid 26*a* is configured to be in an opened state by being pushed down by the user and in a closed state by being pushed up. In FIG. 1, the front lid 26*a* is in the opened state. The upper lid 26*b* is provided at the upper portion of the recording unit 20 to cover a paper feed roller (not shown) and the like. The upper lid 26*b* is configured to be in an opened state by being pushed up by the user and in a closed state by being pushed down. In FIG. 1, the upper lid 26*b* is in the closed state.

The operation panel 27 is an operation unit for operating the printing apparatus 1 by the user and is provided on the right of the upper lid 26*b* of the recording unit 20 in the figure. In the operation panel 27, a display screen 27*a* configured of, for example, a liquid crystal device and various buttons (not shown) are installed, and the buttons can be operated while the user views and checks the display screen. The display screen 27*a* of the operation panel 27 may be configured as a touch panel. Driving control of the operation panel 27 is performed by, for example, the control unit 100.

The maintenance unit 29 prevents an increase in the viscosity of the ink in the vicinity of the nozzle openings of the recording head 28. The paper discharge unit 30 is provided on the lower side of the recording unit 20 and has a paper discharge roller 31*a* and a paper discharge guide 31*b*. The paper discharge roller 31*a* is provided to abut on the roll paper, and the roll paper is sent out in a sub-scanning direction (a direction orthogonal to the main scanning direction) via the paper discharge roller 31*a*. The paper discharge guide 31*b* is provided to protrude toward the front surface side of the recording unit 20, and the roll paper is guided in the sub-scanning direction via the paper discharge guide 31*b*.

The leg section 3 includes two support columns 42 having rollers 41 for moving and a reinforcing bar 43 suspended between the support columns 42. The recording unit 20 is screwed and fixed to the upper parts of the support columns 42. A predetermined space is provided between the support columns 42 to dispose a paper receiving device that receives the roll paper discharged from the paper discharge unit 30.

Figure 2:
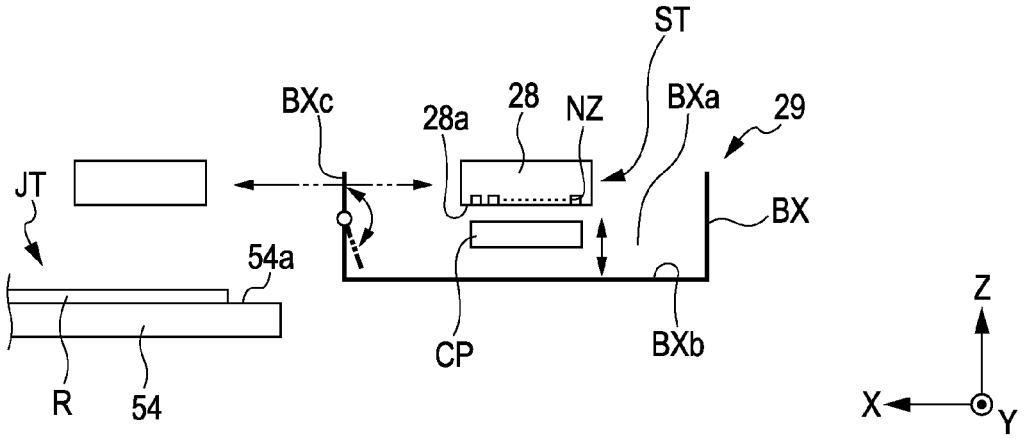
FIG. 2 is a diagram illustrating the configuration of a part of the printing apparatus according to the embodiment.

FIG. 2 is a diagram illustrating a cross-sectional configuration of the printing apparatus 1.

As illustrated in FIG. 2, in an accommodation unit C, a sheet support portion 54, the recording head 28, and the maintenance unit 29 are accommodated. The sheet support portion 54 has a support surface 54*a* that supports the roll paper R transported to the recording unit 20. The support surface 54*a* is formed to be parallel to, for example, the XY plane. The roll paper R is transported on the support surface 54*a* in the +Y direction in the figure.

The recording head 28 is provided to be movable in the X direction so as to cross the +Z side of the sheet support portion 54 and the +Z side of the maintenance portion 29. The recording head 28 ejects ink onto the roll paper R supported on the support surface 54*a* of the sheet support portion 54. As described above, in the accommodation unit C, a region where the roll paper R is disposed on the support surface 54*a* of the sheet support portion 54*a* becomes an ejection region JT for the recording head 28. In addition, the recording head 28 is in a standby state in which the nozzle formation surface 28*a* faces the lower side (−Z side) in the vertical direction at a standby position ST deviating from the ejection region JT during non-ejection of ink. In FIG. 2, the configuration in the case where the recording head 28 is in the standby state is illustrated.

The maintenance unit 29 is disposed on the −X side of the sheet support portion 54. Therefore, the maintenance unit 29 is provided at the standby position ST deviating from the ejection region. The maintenance unit 29 is provided so as to be elevated in the Z direction. The maintenance unit 29 has a head accommodation portion BX and the capping portion CP.

The head accommodation portion BX is provided at the standby position ST. The head accommodation portion BX is formed in a rectangular box shape and the +Z side thereof is opened. Therefore, the head accommodation portion BX is configured to have a concave portion BXa therein. The head accommodation portion BX at least accommodates a part of the recording head 28 including the nozzle formation surface 28*a* in the standby state in the concave portion BXa. A bottom portion BXb of the concave portion BXa of the head accommodation portion BX is provided to oppose the nozzle formation surface 28*a* in a state where a part of the recording head 28 is accommodated.

The head accommodation portion BX has an opening and closing portion BXc for ensuring a movement path of the recording head 28. The opening and closing portion BXc is provided at a wall portion of the head accommodation portion BX on the +X side. The opening and closing portion BXc is formed so that a part of the wall portion of the head accommodation portion BX on the +X side is rotated about the Y axis. The opening and closing operation of the opening and closing portion BXc is controlled by the control unit 100.

The opening and closing unit BXc is in an erected state in the +Z direction in the case where the recording head 28 performs the ejection operation in the ejection region JT and in the case where the recording head 28 is in the standby state at the standby position ST. When the recording head 28 is moved between the ejection region JT and the standby position ST, the opening and closing portion BXc is rotated about the Y axis (shown as the dot-dashed line in the figure) so as to empty the movement path of the recording head 28. Therefore, when the recording head 28 is moved between the ejection region JT and the standby position ST, the recording head 28 and the wall portion of the head accommodation portion BX do not collide with each other.

The capping portion CP is accommodated in the concave portion BXa of the head accommodation portion BX. The capping portion CP is provided so as to be movable in the Z direction. The capping portion CP is formed to cover the nozzle formation surface 28*a* of the recording head 28 in the standby state at the standby position ST. A suction mechanism (not shown) is mounted on the capping portion CP. Therefore, ink in nozzles NZ can be sucked in the state where the nozzle formation surface 28*a* is covered with the capping portion CP. The suction operation by the capping portion CP is controlled by, for example, the control unit 100.

In this embodiment, ink containing a pigment component and a solvent is used. As the solvent in a vaporized state, a material having a specific gravity greater than that of air, for example, an organic solvent as follows is used. Examples of the material include ethylene glycol monobutyl ether and propylene glycol monomethyl ether acetate.

Examples of the ethylene glycol monobutyl ether include 2-butoxyethanol ($C_6H_{14}O_2$), 2-(2-butoxyethoxy)ethanol ($C_8H_{18}O_3$), diethylene glycol monobutyl ether acetate ($C_{10}H_{20}O_4$), 2-butoxyethyl acetate ($C_8H_{16}O_3$), triethylene glycol monobutyl ether ($C_{10}H_{22}O_4$), 3,6,9,12-tetraoxahexadecan-1-ol ($C_{12}H_{26}O_5$), and ethylene glycol monobutyl ether p-dimethylaminobenzoate ($C_{15}H_{23}NO_3$).

As the propylene glycol monomethyl ether acetate, for example, propylene glycol monomethyl ether acetate such as propylene glycol monomethyl ether acetate ($C_6H_{12}O_3$) or dipropylene glycol monomethyl ether acetate ($C_9H_{18}O_4$) may be employed.

As alternative materials to those, ethylene glycol monomethyl ether, ethylene glycol monomethyl ether acetate, diethylene glycol monomethyl ether, diethylene glycol monomethyl ether acetate, diethylene glycol monoethyl ether, diethylene glycol, propylene glycol monoethyl ether acetate, propylene glycol, cyclohexanone, and the like may be employed.

Furthermore, diethylene glycol diethyl ether ($C_8H_{18}O_3$), tetraethylene glycol dimethyl ether ($C_{10}H_{22}O_5$), diethylene glycol methyl ethyl ether, and the like may be employed.

Next, the operation of the printing apparatus 1 configured as described above will be described.

Figure 3:
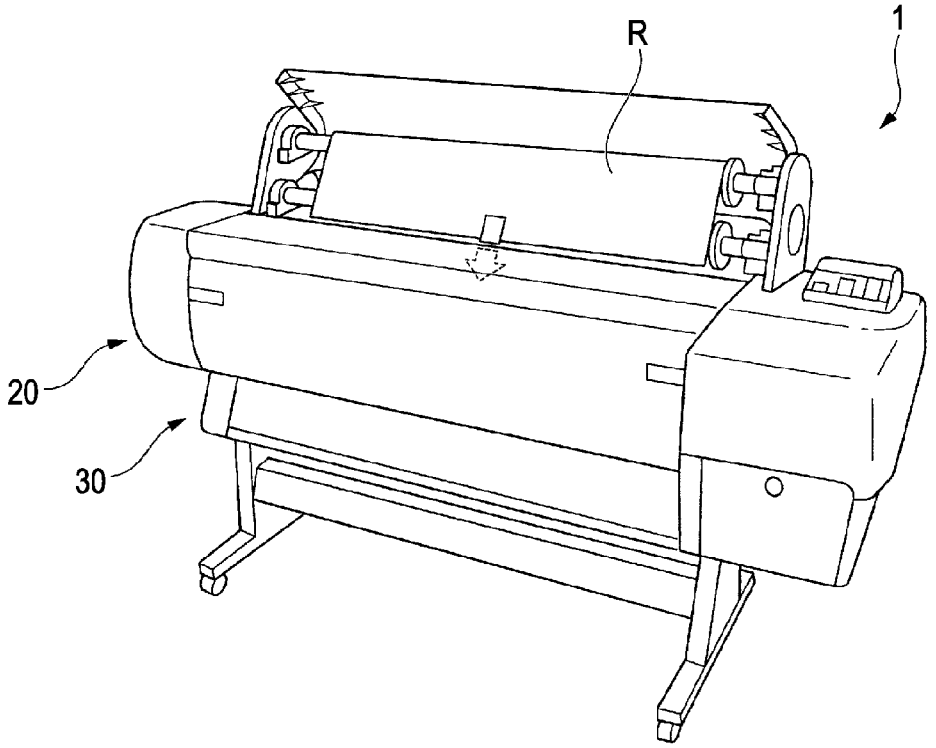
FIG. 3 is a diagram illustrating an operation of the printing apparatus according to the embodiment.

First, the spindle portion 13 inserted through the roll paper R is mounted to the spindle receiving portions 14 and 15, and the front end of the roll paper R is drawn down so as to pass to the transportation path of the paper discharge unit 30 through the transportation path of the recording unit 20 as illustrated in FIG. 3.

Figure 4:
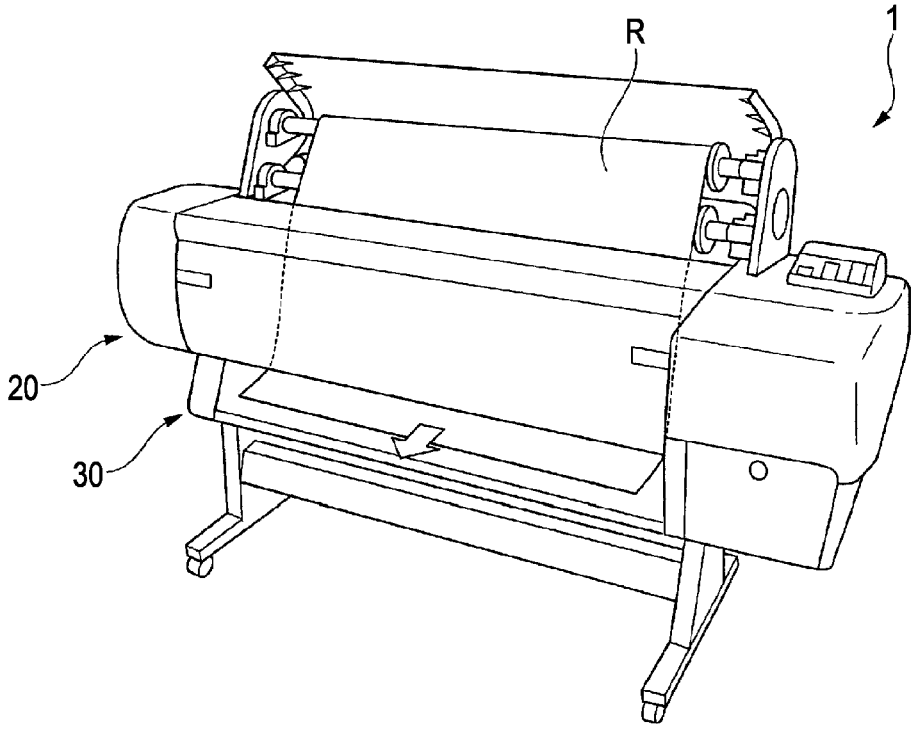
FIG. 4 is a diagram illustrating an operation of the printing apparatus according to the embodiment.

Next, as illustrated in FIG. 4, the roll paper R is rotated in a winding direction so that the front end of the roll paper R is positioned to, for example, a marker (not shown) formed in the paper discharge guide 46. Thereafter, operation of the printing apparatus 1 is started, and ink droplets are discharged while the roll paper R is fed in the sub-scanning direction and the recording head 28 is moved in the main scanning direction in the ejection region JT, so that predetermined information is recorded on the roll paper R and the roll paper R is discharged.

Figure 5:
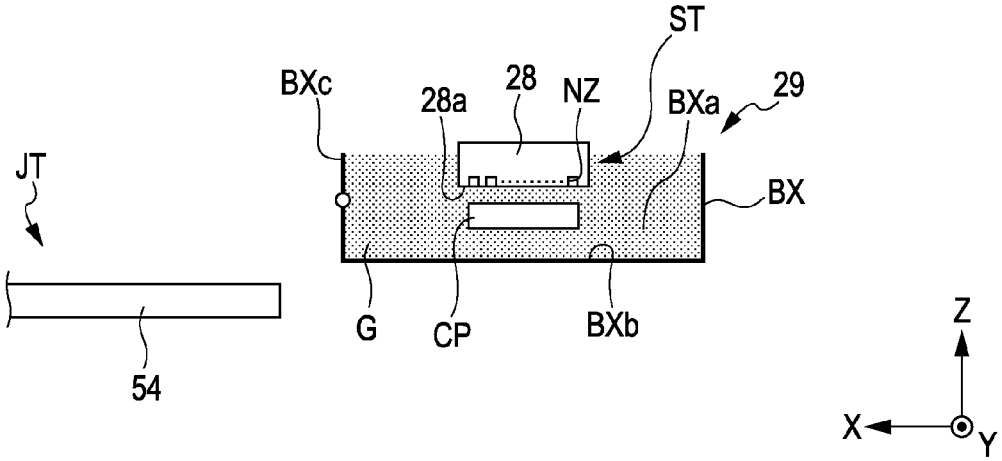
FIG. 5 is a diagram illustrating an operation of the printing apparatus according to the embodiment.

In the printing apparatus 1, when ink is not ejected from the recording head 28 (during non-ejection) such as in the case where a printing operation is not performed, the control unit 100 causes the nozzle formation surface 28*a* to be on standby while facing the lower side (−Z side) in the vertical direction at the standby position ST deviating from the ejection region JT (standby state). Here, the control unit 100 adjusts the position of the recording head 28 in the Z direction so that the nozzle formation surface 28*a* of the recording head 28 is positioned in the concave portion BXa of the head accommodation portion BX and the nozzle formation surface 28*a* opposes the bottom portion BXb. By this operation, as illustrated in FIG. 5, a part of the recording head 28 at least including the nozzle formation surface 28*a* is accommodated in the concave portion BXa of the head accommodation portion BX.

For example, there may be cases where the solvent contained in the ink is vaporized in the periphery of the recording head 28 and the like. In this embodiment, since an organic solvent in a vaporized state having a specific gravity greater than that of air is used as the solvent, the organic solvent (vaporized component) G vaporized in the periphery of the recording head 28 is moved to the lower side (−Z side) in the vertical direction.

Since the nozzle formation surface 28*a* is accommodated in the concave portion BXa in the standby state of the recording head 28 and the bottom portion BXb of the concave portion BXa opposes the nozzle formation surface 28*a*, for example, the vaporized component G vaporized in the periphery of the recording head 28 in the standby state is moved to the bottom portion BXb of the concave portion BXa and is gradually collected from the bottom portion BXb. When the vaporized component G is collected in the concave portion BXa, as illustrated in FIG. 5, the periphery of the nozzle formation surface 28*a* accommodated in the concave portion BXa is filled with the vaporized component G. Therefore, vaporization of the solvent from the nozzles NZ is suppressed.

The control unit 100 may cause the nozzle formation surface 28*a* to be sealed using the capping portion CP in the standby state of the recording head 28. In this case, in the state where the concave portion BXa is filled with the vaporized component G, the nozzle formation surface 28*a* can be sealed. Therefore, regardless of gas barrier properties of the capping portion CP itself, vaporization of the solvent from the nozzle formation surface 28*a* can be reduced.

As described above, according to this embodiment, since the head accommodation portion BX is provided so that the concave portion BXa that accommodates at least a part including the nozzle formation surface 28*a* of the recording head 28 in the standby state is included, and the bottom portion BXb of the concave portion BXa opposes the nozzle formation surface 28*a* in the state where the part is accommodated, the periphery of the nozzle formation surface 28*a* accommodated in the concave portion BXa can be filled with the vaporized component G. Accordingly, vaporization of the solvent from the nozzle formation surface 28*a* can be reduced.

The technical scope of the invention is not limited to the embodiment, and various modifications can be added in a range without departing from the gist of the invention.

In this embodiment, the embodiment in which the solvent (vaporized component G) vaporized in the periphery of the recording head 28 is accommodated in the head accommodation portion BX is exemplified. However, the invention is not limited thereto.

Figure 6:
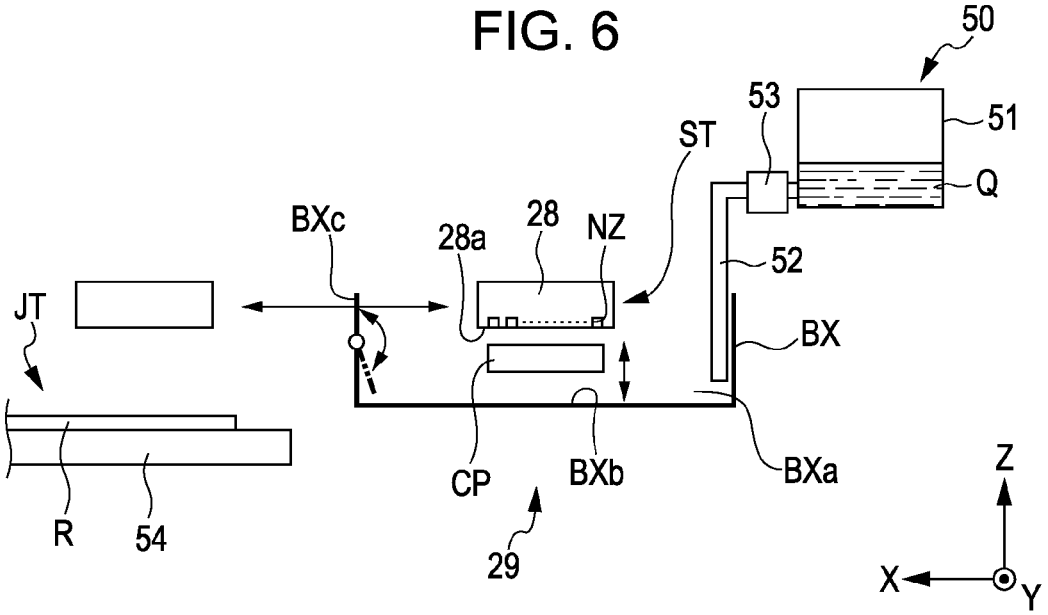
FIG. 6 is a diagram illustrating the configuration of a part of a printing apparatus according to another embodiment of the invention.

For example, as illustrated in FIG. 6, a configuration may also be employed in which a liquid component supply unit 50 which supplies a liquid solvent Q (liquid component) to the concave portion BXa of the head accommodation portion BX is provided. The liquid component supply unit 50 has a storage portion 51 that stores the liquid component Q, a tube portion 52 that connects the storage portion 51 to the concave portion BXa, and a movement portion 53 that moves the liquid component Q stored in the storage portion 51 to the concave portion BXa via the tube portion 52. As the movement portion 53, a valve that opens or closes the tube portion 52, a pump mechanism, or the like may be used.

Figure 7:
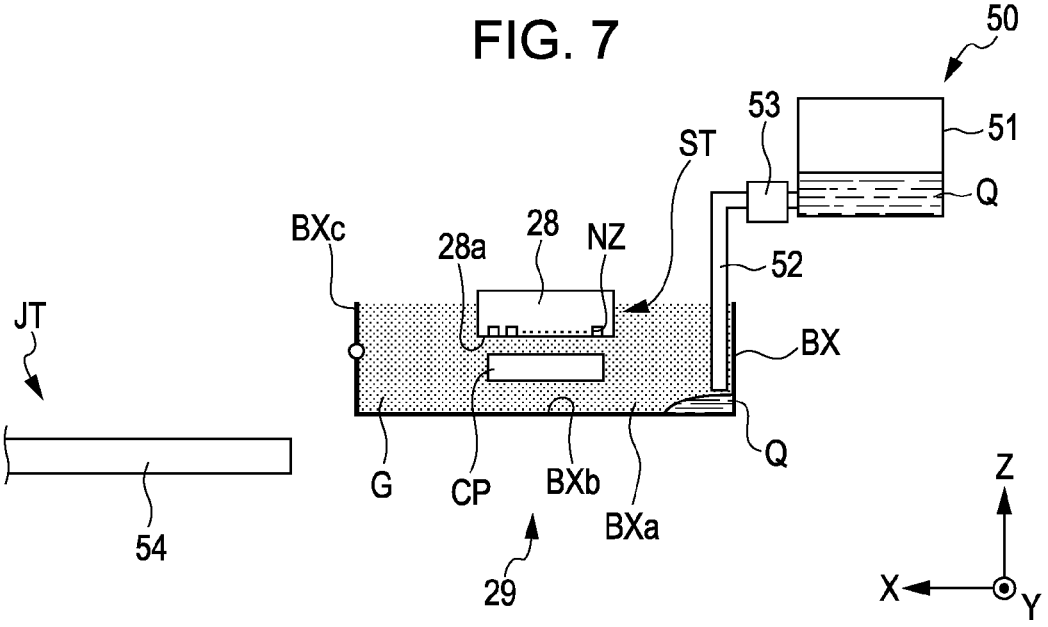
FIG. 7 is a diagram illustrating an operation of a part of a printing apparatus according to another embodiment of the invention.

As illustrated in FIG. 7, the control unit 100 causes the liquid component Q in the storage portion 51 to move to the concave portion BXa via the tube portion 52 using the movement portion 53. When the liquid component Q is supplied to the concave portion BXa by this operation, a vaporized component G is generated from the liquid component Q. The generated vaporized component G has a greater specific gravity than that of air and thus is gradually collected from the bottom portion BXb of the concave portion BXa.

Therefore, even in this case, the periphery of the nozzle formation surface 28*a* accommodated in the concave portion BXa can be filled with the vaporized component G. Accordingly, vaporization of the solvent from the nozzle formation surface 28*a* can be reduced.

Figure 8:
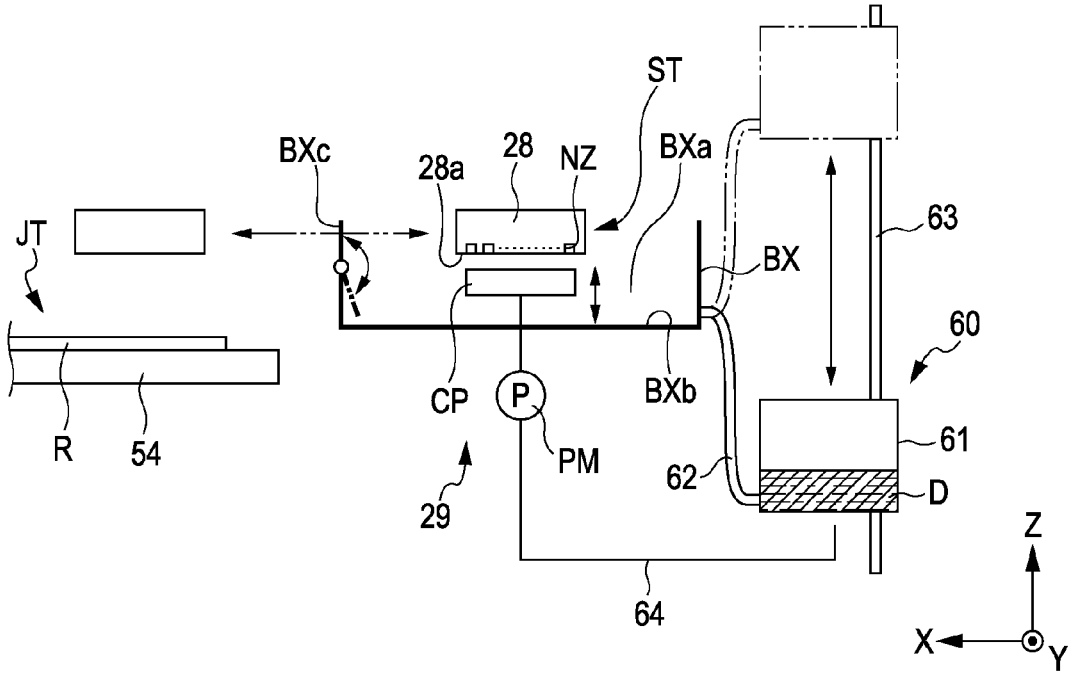
FIG. 8 is a diagram illustrating the configuration of a part of a printing apparatus according to another embodiment of the invention.

In addition, for example, as illustrated in FIG. 8, a configuration in which a recovery unit 60 that recovers waste ink D discharged from the recording head 28 is used as the liquid component supply unit may be employed. The recovery unit 60 has, for example, a storage portion 61 that stores the waste ink D discharged using a suction pump PM or the like connected to the capping portion CP, a tube portion 62 that connects the storage portion 61 to the concave portion BXa, a movement portion 63 that moves the waste ink D stored in the storage portion 61 to the concave portion BXa via the tube portion 62, and a second tube portion 64 that circulates the waste ink D from the suction pump PM to the storage portion 61. As the movement portion 63, an elevation mechanism that moves the storage portion 61 in the Z direction or the like may be used.

Figure 9:
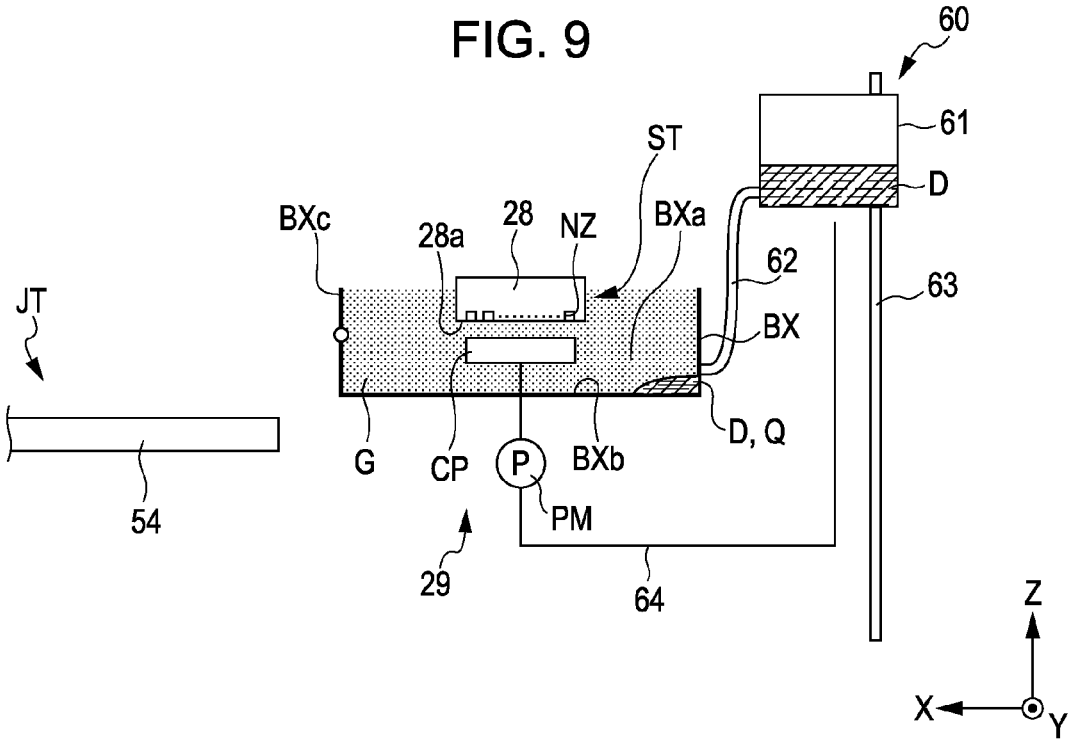
FIG. 9 is a diagram illustrating the operation of a part of a printing apparatus according to another embodiment of the invention.

As illustrated in FIG. 9, the control unit 100 causes the storage portion 61 to move in the +Z direction by the movement portion 63. When the storage portion 61 is disposed more on the +Z side than a connection portion of the tube portion 62 and the concave portion BXa, the waste ink D in the storage portion 61 is moved to the concave portion BXa via the tube portion 62 by gravity. When the waste ink D is supplied to the concave portion BXa by this operation, a vaporized component G is generated from the liquid component Q contained in the waste ink D. The generated vaporized component G has a greater specific gravity than that of air and thus is gradually collected from the bottom portion BXb of the concave portion BXa.

Even in this case, the periphery of the nozzle formation surface 28*a* accommodated in the concave portion BXa can be filled with the vaporized component G. Accordingly, vaporization of the solvent from the nozzle formation surface 28*a* can be reduced. In addition, the control unit 100 causes the storage portion 61 to be returned to its original position using the movement portion 63 after the necessary amount of the waste ink D is supplied.

In addition, for example, a configuration in which the storage portion 61 is disposed inside the concave portion BXa of the head accommodation portion BX may be employed. In this case, the +Z side of the storage portion 61 is opened. In this configuration, in a case where the waste ink D is recovered and stored in the storage portion 61, the vaporized component G can be directly generated from the stored waste ink D.

In addition, for example, the liquid solvent (liquid component) Q may be supplied by ejecting ink onto the concave portion BXa of the head accommodation portion BX from the recording head 28. Even in this case, the periphery of the nozzle formation surface 28*a* accommodated in the concave portion BXa can be filled with the vaporized component G. Accordingly, vaporization of the solvent from the nozzle formation surface 28*a* can be reduced.

In addition, for example, a configuration provided with a vaporized component supply unit that directly supplies the vaporized component G to the concave portion BXa may also be employed. Hereinafter, as a configuration illustrated in FIG. 8, the configuration provided with the vaporized component supply unit is exemplified. However, the invention is not limited to this configuration. For example, a configuration in which the vaporized component supply unit is provided for the configuration illustrated in FIG. 6 may also be employed.

Figure 10:
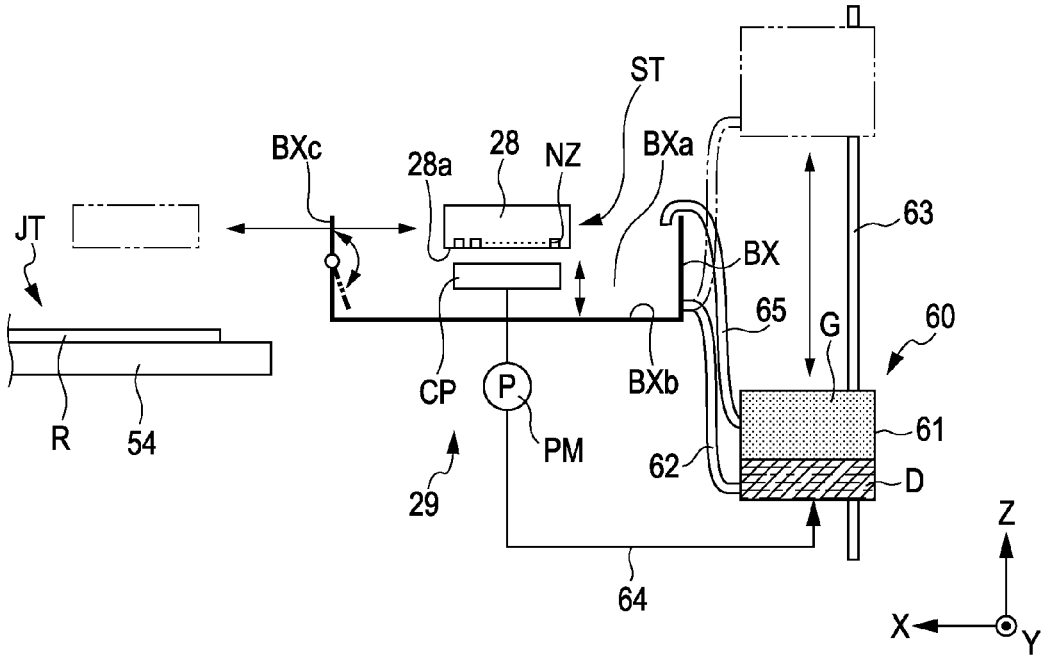
FIG. 10 is a diagram illustrating the configuration of a part of a printing apparatus according to another embodiment of the invention.

As illustrated in FIG. 10, a vaporized component supply unit 65 is formed in a tube shape. One end of the vaporized component supply unit 65 is disposed at the +Z side end portion of the concave portion BXa and the other end thereof is connected to the storage portion 61. The vaporized component supply unit 65 supplies the vaporized component G of the solvent vaporized in the storage portion 61 to the concave portion BXa.

Figure 11:
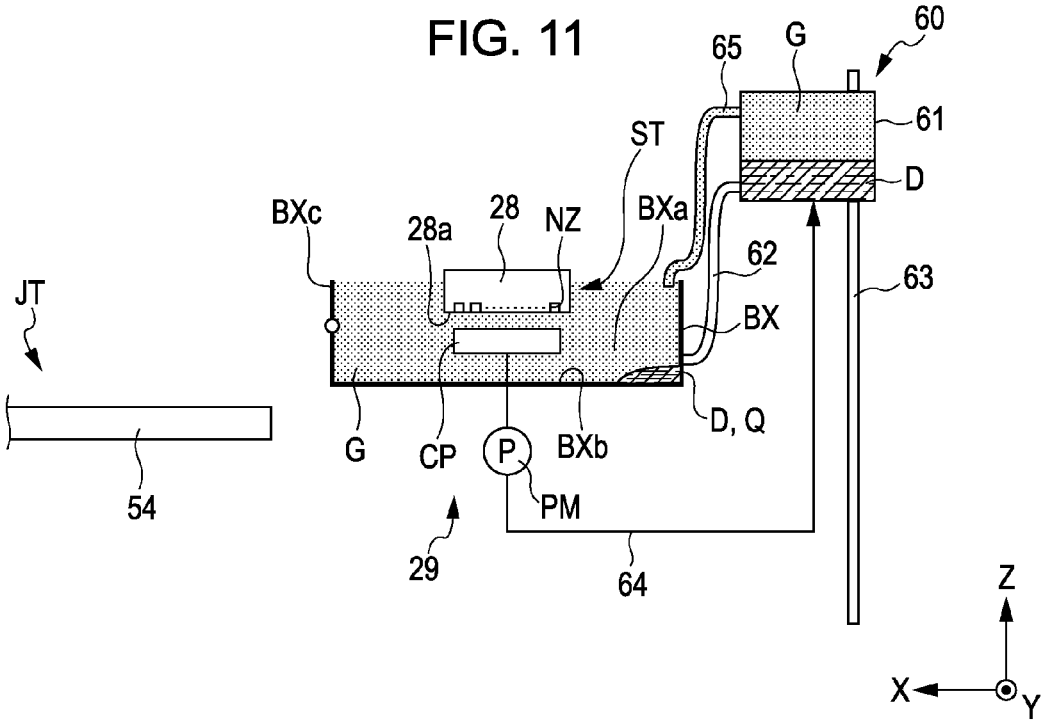
FIG. 11 is a diagram illustrating the operation of a part of a printing apparatus according to another embodiment of the invention.

As illustrated in FIG. 11, the control unit 100 causes the storage portion 61 to move in the +Z direction by the movement portion 63. When the storage portion 61 is disposed more on the +Z side than the connection portion of the tube portion 62 and the concave portion BXa, the waste ink D in the storage portion 61 is moved to the concave portion BXa via the tube portion 62 by gravity. At the same time, the vaporized component G in the storage portion 61 is moved to the concave portion BXa by gravity. By this operation, the waste ink D and the vaporized component G are supplied to the concave portion BXa. In the concave portion BXa, the vaporized component G is generated from the liquid component Q contained in the waste ink D and the directly supplied vaporized component G is disposed. The vaporized component G has a greater specific gravity than that of air and thus is gradually collected from the bottom portion BXb of the concave portion BXa.

Therefore, even in this case, the periphery of the nozzle formation surface 28*a* accommodated in the concave portion BXa can be filled with the vaporized component G. Accordingly, vaporization of the solvent from the nozzle formation surface 28*a* can be reduced. In addition, the control unit 100 causes the storage portion 61 to be returned to its original position using the movement portion 63 after needed amounts of the waste ink D and the vaporized component G are supplied.

In addition, in this embodiment, the configuration in which the liquid component Q, the gas component G, and the waste ink D are supplied into the concave portion BXa is exemplified. However, the invention is not limited to this. For example, a configuration in which water is supplied into the concave portion BXa may also be employed. Otherwise, a configuration in which an inert gas such as nitrogen is supplied into the concave portion BXa may also be employed.

In the embodiments described above, a recording apparatus that employs the ink jet type as a recording type is described, but may also be modified to a recording apparatus in an arbitrary recording type such as an electrophotographic type or a thermal transfer type. In addition, the recording apparatus is not limited to a printer and may be a FAX device, a copying device, or a multi-function machine having a plurality of functions thereof. Moreover, as the recording apparatus, a liquid ejecting apparatus having a liquid ejecting head that ejects or discharges a minute amount of liquid droplets of a liquid other than ink, and the like may be employed.

In addition, the liquid droplets represent liquid states discharged from the liquid ejecting apparatus, the liquid states including granular, tear-like, and thread-like shapes with trails. The liquid mentioned herein may be any material that can be ejected by the liquid ejecting apparatus. For example, the materials may be in a liquid phase, and may include liquid materials with high or low viscosities, sol, gel water, fluid-state materials such as inorganic solvents, organic solvents, solutions, liquid resins, and liquid metal (metallic melt), and in addition to liquids as a state of the material, a material in which particles of functional materials made of solids such as pigments or metallic particles are dissolved, dispersed, or mixed with the solvent. In addition, as a representative example of the liquid, there is the ink described above in the embodiment or a liquid crystal.

Here, the ink may include various kinds of liquid compositions such as general water-based ink, oil-based ink, gel ink, hot-melt ink, and the like. Specific examples of the liquid ejecting apparatus may include liquid crystal displays, EL (electroluminescence) displays, surface light-emitting displays, liquid ejecting apparatuses for ejecting liquid in which materials such as electrode materials used for manufacturing color filters and color materials are dispersed or dissolved, and printing apparatuses.

The entire disclosure of Japanese Patent Application No. 2011-048713, filed Mar. 7, 2011 is expressly incorporated by reference herein.

What is claimed is:

1. A liquid ejecting apparatus comprising:

a liquid ejecting head which has a nozzle formation surface in which nozzles are formed that eject a liquid, the liquid containing a solvent whose vapors have a specific gravity greater than that of air, the liquid ejecting head being movable between an ejection region where the liquid ejecting head ejects the liquid onto a recording medium and a standby position apart from the ejection region; and a head accommodation portion which has a concave portion that accommodates at least a part including the nozzle formation surface of the liquid ejecting head with a vaporized component of the liquid collected within the concave portion in the standby position, the vaporized component having a specific gravity greater than that of air, wherein the concave portion has a bottom portion and side walls extending from the bottom portion and an opening portion in a top portion of the concave portion that is defined by the side walls, wherein the top portion of the concave portion is located at a position higher than the nozzle formation surface without the side walls contacting with the liquid ejecting head such that at least a part of the opening portion is opened in a standby state where the part is accommodated, wherein the vaporized component of the liquid is collected within the concave portion in a state where at least the part of the opening portion is opened and the nozzle formation surface is not sealed, wherein the head accommodation portion has an opening and closing portion on a side wall that is located on the ejection region of the side walls, wherein the opening and closing portion includes a top portion of the side wall so that the top portion of the side wall is located at the position higher than the nozzle formation surface in a case where the liquid ejecting head is in the ejection region or in the standby position and is located at a position lower than the nozzle formation surface in a case where the liquid ejecting head moves between the ejection region and the standby position.

2. The liquid ejecting apparatus according to claim 1, further comprising a cap portion which is accommodated in the concave portion and is provided so as to be movable between a seal position where the cap seals the nozzle formation surface and a non-seal position where the cap is apart from the nozzle formation surface in a state where the concave portion is filled with the vaporized component of the liquid.

3. The liquid ejecting apparatus according to claim 1, further comprising a liquid component supply unit which supplies a liquid component of the solvent to the concave portion.

4. The liquid ejecting apparatus according to claim 3, wherein the liquid component supply unit includes:

a storage portion that stores the liquid component;

a tube portion that connects the storage portion to the concave portion; and a movement portion which moves the liquid component stored in the storage portion to the concave portion via the tube portion.

5. The liquid ejecting apparatus according to claim 4, further comprising a recovery unit that recovers the liquid discharged from the liquid ejecting head, wherein the recovery unit is used as the storage portion that stores the liquid component of the solvent contained in the liquid.

6. The liquid ejecting apparatus according to claim 4, wherein the movement portion moves the liquid component stored in the storage portion to the concave portion by moving the storage portion in a direction perpendicular and relative to the head accommodation portion.

7. The liquid ejecting apparatus according to claim 1, further comprising a vaporized component supply unit that supplies a vaporized component of the solvent to the concave portion.

8. The liquid ejecting apparatus according to claim 1, wherein the vaporized component of the liquid is collected within the concave portion by the liquid ejecting head ejecting the liquid into the concave portion.

* * * * *